US007331069B2

(12) United States Patent
Chu

(10) Patent No.: US 7,331,069 B2
(45) Date of Patent: Feb. 19, 2008

(54) WATER-SAVING FLUSH TOILET

(76) Inventor: Hunghing Chu, Room 2114, Tsui Shou House, Tsui Wan Estate, Chai Wan (HK)

( * ) Notice: Subject to any disclaimer, the term of this patent is extended or adjusted under 35 U.S.C. 154(b) by 302 days.

(21) Appl. No.: 10/955,895

(22) Filed: Sep. 30, 2004

(65) Prior Publication Data

US 2005/0155143 A1 Jul. 21, 2005

(30) Foreign Application Priority Data

Jan. 21, 2004 (CH) ..... 2004 2 0019786 U

(51) Int. Cl.
*E03D 11/10* (2006.01)

(52) U.S. Cl. ..... 4/438; 4/434; 4/441

(58) Field of Classification Search ..... 4/434–436, 4/438, 249, 366, 437, 439, 440, 441
See application file for complete search history.

(56) References Cited

U.S. PATENT DOCUMENTS 116,086 A * 6/1871 Norboe ..... 4/435
196,721 A * 10/1877 Sulzbacher ..... 4/435
251,813 A * 1/1882 Atwater ..... 4/438
280,017 A * 6/1883 Dutton ..... 4/435
418,580 A * 12/1889 Mayo ..... 4/438
3,798,681 A * 3/1974 Johansen ..... 4/440

* cited by examiner

*Primary Examiner*—Robert M. Fetsuga
(74) *Attorney, Agent, or Firm*—Jones Day

(57) ABSTRACT

A water-saving flush toilet is disclosed. A discharge seal valve is arranged at a sewage discharge port, a discharge seal valve together with a valve cover are arranged at a valve seat. A water tap handle at the lower of the bowl is provided with a lever, a cord is connected between a handle of the valve cover and the lever via a joint of the bowl. The lever is also connected to another cord that is connected to a weight via said two joints. The upper of the bowl is arranged with a water channel and a sprinkler head, an open of said water channel connected to the water tap at the lower of the bowl via a connecting plastic tube, water pipes are arranged respectively at the upper and the lower of the bowl without any water tank.

9 Claims, 3 Drawing Sheets

WATER-SAVING FLUSH TOILET

TECHNICAL FIELD

The present invention is related to a sanitary installation, specifically to a water-saving flush toilet.

TECHNICAL BACKGROUND

The current flush toilet always uses a siphon pipe to suck/discharge a sewage and to isolate the smell gas. During the discharging, water is firstly filled into the water tank to replenish as a level to the top of the siphon pipe. When discharging a large amount of water to expel the air in a water discharging pipe of the siphon pipe in order to form vacuum such that a pressure difference is produced between both ends. Finally, sewage together with water is discharged into a sewage-discharging pipe by the atmosphere pressure. In regard to the sewage-discharging pipe, the sewage in the flush toilet bowl is sucked into the sewage-discharging pipe and discharged by the sewage-discharging pipe.

The higher the top of the siphon pipe in the water tank, the larger the diameters of sewage discharging pipe, then the more water needed in generating the vacuum. Since the water needed is to generate the vacuum only, water is a "pro-waste" for this single purpose on discharging sewage. It is a disadvantage in the environmental protection and in the full utilization of water resource. Especially, it should be fonder of water in water-deficient areas. Another function of the siphon pipe is to retain water below a level of the top of the siphon pipe to isolate the smell gases flowing into a room so as to keep the flesh and clean of the air in said room.

The current siphon pipe type flush toilet must be provided with a water tank to store a large amount of water to be flush out in a short period so as to generate vacuum in the siphon pipe. If there is no water tank, it still is possible to form vacuum in the discharging end of the siphon pipe for the high-pressure water source, but does not work for a low-pressure water source. That is, the amount of flushing water is not enough to expel all air in the discharging pipe. In the other words, the replenishing water is not as fast as the discharging water. For the high-pressure water source, although it is possible to provide a large amount of water to form the vacuum in the siphon pipe, the discharged water should be deemed as waste.

THE SUMMARY OF INVENTION

The object of the present invention is to provide an improved water-saving flush toilet to solve the problem of heavy water consumption and the waste of water resource for the current siphon of the pipe flush toilet.

The technical solution of the present invention as follows:

It is to provide a water-saving flush toilet, comprising a bowl having a seat and a sewage discharge port, characterized in that a siphon pipe is omitted at the rear of a sewage discharge pipe of the bowl, a discharge seal valve is arranged at the sewage discharge port, the discharge seal valve together with a valve cover are arranged at a valve seat, a water tap handle at the lower of the bowl is provided with a lever, a cord is connected between a handle of the valve cover and a joint of the bowl, said cord is connected to hang a weight via another joint of the bowl while another end of the lever is connected to another cord and also connected to said weight via said two joints; the upper of the bowl is arranged with a water channel and a sprinkler head, an open of said water channel connected to the water tap at the lower of the bowl via a connecting plastic tube, water pipes are arranged respectively at the upper and the lower of the bowl without any water tank.

Water-saving flush toilet of the present invention is adapted to a motor or foot-operated flush toilet to avoid or eliminate disease spreading via touching by hand. If it is motorized, the flushing is automated finished once by pressing a button. Said button can be installed on the top of the storage bin or just on the ground. Said motor is suitable to be operated at a 20V for safety reason.

A water tank is omitted in this present invention and the cost is lowered as well as increasing the space of the cleaning room. Moreover, it can be replaced by a pleasing design storage bin for sanitary accessories to be used conveniently. The filling time of water tank in a traditional flush toilet is generally takes for 1 to 5 minutes, while the flushing time for the present water-saving flush toilet is only 2 seconds without the filling of water tank, which obviously saves time in flushing and water used.

The present invention can be used in water-deficient areas, an auxiliary used water tank can be connected to the water inlet so as to fully utilize used water such as water from cloth-washing or cleansing.

If it is possible, metal material should be avoided to be used as the parts in the present invention for preventing corrosion that the working life could be improved.

DETAIL DESCRIPTION

Figure 1:
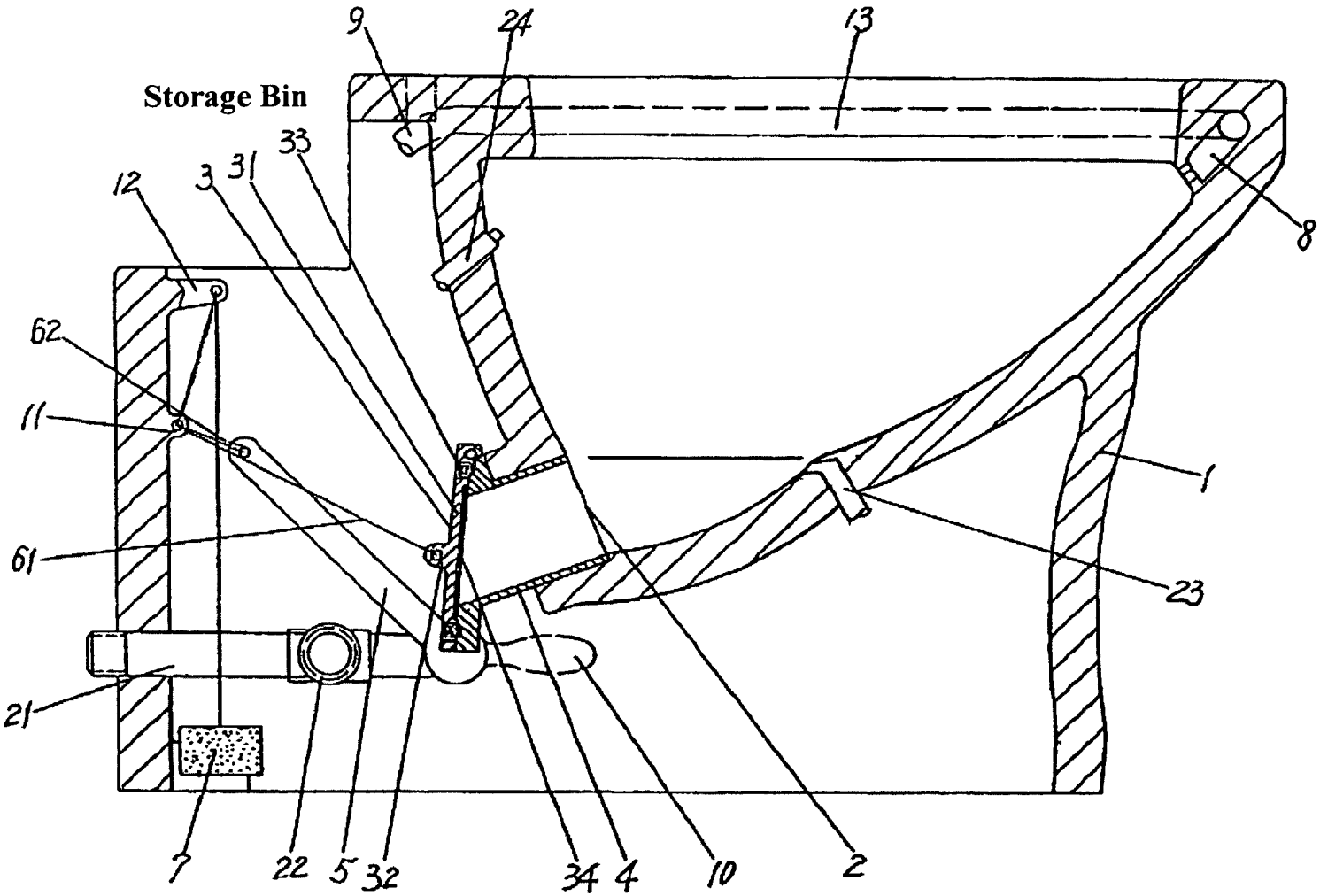
FIG. 1 is a schematic structure view of a water-saving flush toilet with a storage bin.

With reference to FIG. 1, the present invention is a water-saving flush toilet that is a bowl 1 having a seat and a sewage discharge port 2. The bowl 1 is made of resin porcelain clay or porcelain clay. A siphon pipe is omitted at the rear of a sewage discharge pipe of the bowl. A discharge seal valve 3 is arranged at the sewage discharge port 2. The discharge seal valve 3 may be arranged at the front end or rear end of the lower portion of the bowl 1. The sewage discharge port 2 would be out of sight if the discharge seal valve 3 is arranged at the bottom end of the lower portion of the bowl 1, so that it is pleasing and generous in sight.

The discharge seal valve 3 together with a valve cover 31 are arranged at a valve seat 4. A handle of a water tap 10 at the lower of the bowl is provided with a lever 5. A cord 61 is connected between a handle 32 of the valve cover 31 and a joint 11 of the bowl, said cord 61 is connected to lever 5. Lever 5 is connected to another cord 62 that is also connected to weight 7 via two joints 11, 12. A magnetic attaching device 33 and a rubber seal ring 34 are provided on the valve cover 31 of the discharge seal valve 3. During the use, the magnetic attaching device 33 and/or the weight 7 is to ensure the rubber seal ring 34 to trap water and the valve cover 31 to be closed tightly. In this way, a certain level of water is maintained inside the flush toilet to isolate two ends. No smell gas can be given off from the sewage discharge pipe into the indoor, so flushing and smell blocking is guaranteed.

The upper of the bowl 1 is arranged with a water channel 13 and a sprinkler head 8, an open of said water channel is connected to the water tap 10 at the lower of the bowl via a connecting plastic tube 9. The sprinkler head 8 is a sector-shaped sprinkler head for flushing feces. Water pipes are arranged respectively at the upper and the lower of the bowl without any water tank. Water pipes of diameter 1.2 inch (~12.7 mm) can be used. A lower water pipe 21 has one end connected to water supply pip and another end connected to the water tap 10 via a tee joint 22.

The lower portion inside the bowl 1 is also provided with another sprinkler head 23. Said sprinkler head 23 may be a cylindrical sprinkler head for flushing feces, too. The upper portion of the bowl 1 is provided with a sprinkler head or mist head 24 for spraying human body. Said sprinkler head or mist head 24 can be redirected in two dimension of 100 degree.

Figure 1A:
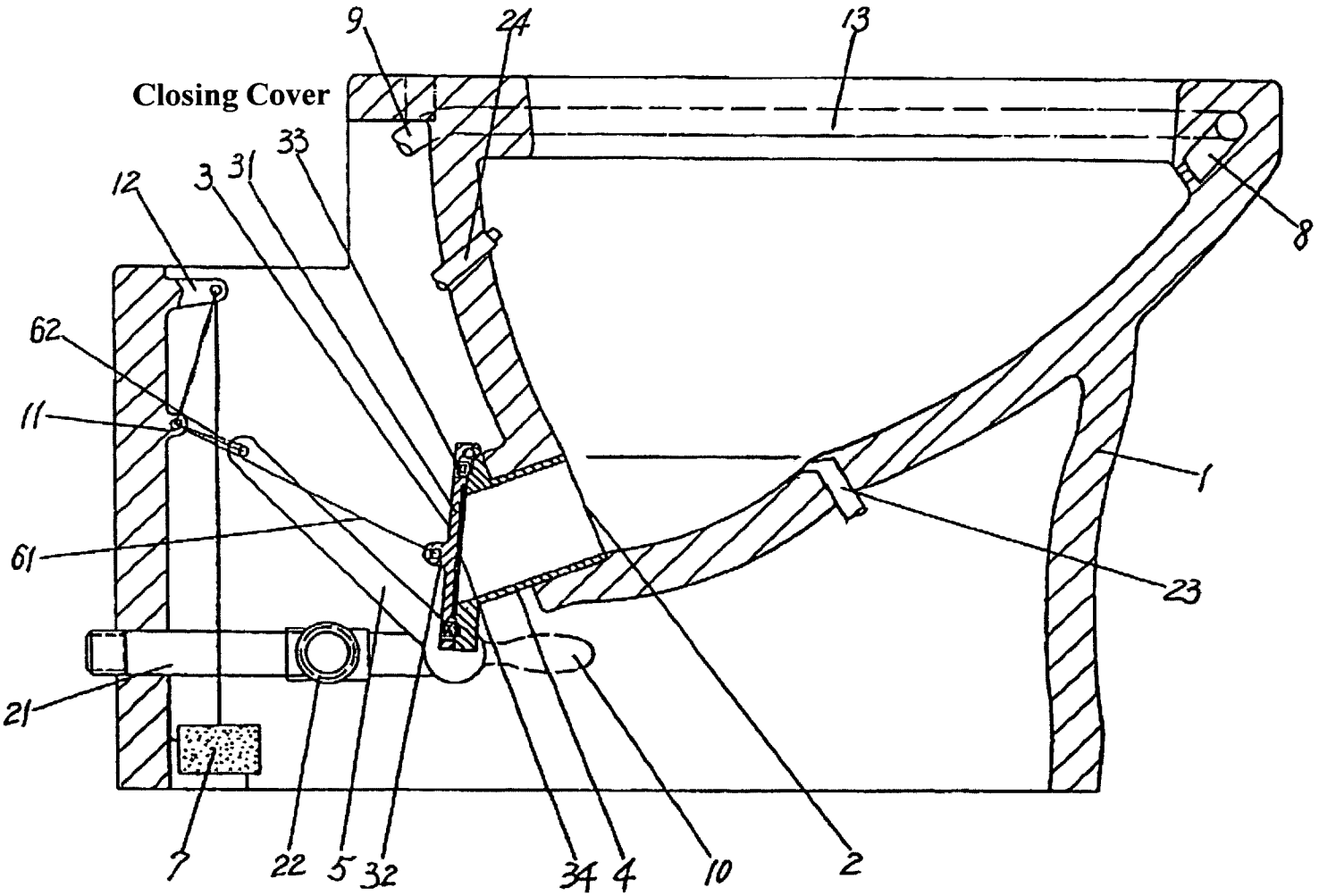
FIG. 1A is a schematic structure view of a water-saving flush toilet with a closing cover.
Figure 2B:
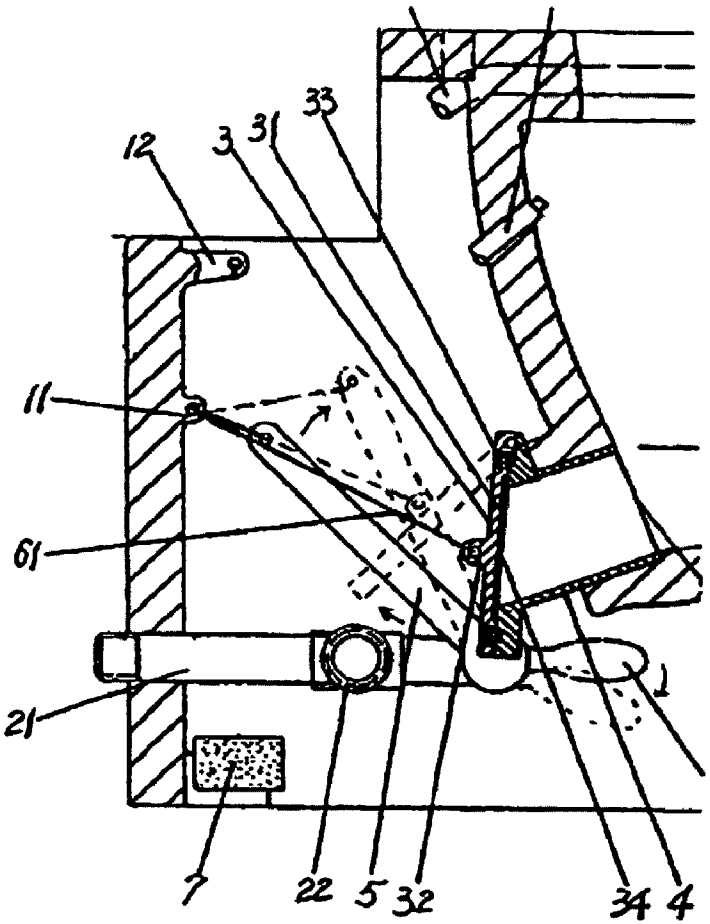
FIG. 2B illustrates the routing of a cable connecting a lever with a valve cover.
Figure 2A:
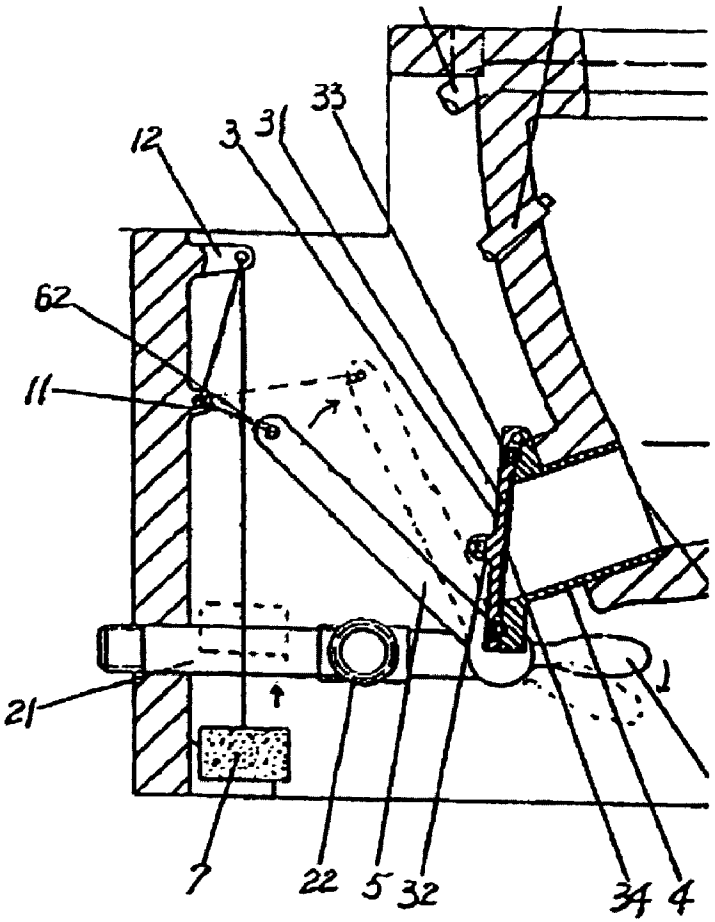
FIG. 2A illustrates the routing of a cable connecting a lever with a weight.

A closing cover shown in FIG. 1A and/or a storage bin shown in FIG. 1 can be mounted at the upper end of the bowl 1 for facilitating in maintenance.

In use of the present invention for flushing sewage, water is trapped when the discharge seal valve is closed, and water is flushed when the discharge seal valve is open. When the handle of a water tap is pressed by foot, water is passing water pipes of diameter 1.2 inch (~12.7 mm) and the connecting plastic tube into the water channel of the bowl. Dirt is washed out by one or two sprinkler heads into the sewage discharge port and sewage discharge main pipe. In that time, the lever of the handle is connected with the two cords, one is to open the discharge seal valve, another is to raise the weight to have potential energy. After water is completely flushed, the weight will be descending to close the water tap via the lever. The valve cover will be closed automatically and is finally closed tightly under the action of magnetic attaching device to be water sealing.

In the present invention, the weight can also be hanged on the valve cover 31 of the discharge seal valve so that the rubber seal ring be tightly pressed to prevent smell gas flowing out.

The invention claimed is:

1. A water-saving flush toilet, comprising:

a bowl having a seat and a sewage discharge port;

a discharge seal valve having a valve cover arranged at the sewage discharge port;

a water tap handle having a lever;

a first cord connecting the valve cover and the lever, the first cord passing through a first joint; and a second cord connecting the lever and a weight, the second cord passing through the first joint and a second joint.

2. The water-saving flush toilet of claim 1, further comprising a first sprinkler arranged in the lower portion of the bowl.

3. The water-saving flush toilet of claim 1, further comprising a second sprinkler arranged in the upper portion of the bowl.

4. The water-saving flush toilet of claim 1 further comprising a magnetic attaching device for providing sealing between the sewage discharge port and the discharge seal valve.

5. The water-saving flush toilet of claim 1 further comprising a rubber seal between the sewage discharge port and the discharge seal valve.

6. The water-saving flush toilet of claim 1 further comprising a closing cover.

7. The water-saving flush toilet of claim 1 further comprising a storage bin.

8. The water-saving flush toilet of claim 1 further comprising a water channel arranged in the rim of the bowl.

9. The water-saving flush toilet of claim 8, wherein the water channel is connected to a water tap.

* * * * *